US009957704B2

(12) United States Patent
Gupta et al.

(10) Patent No.: US 9,957,704 B2
(45) Date of Patent: May 1, 2018

(54) BIDET NOZZLE INSERT

(71) Applicants: Anjum K Gupta, San Diego, CA (US); Emmanuel Pun, San Diego, CA (US)

(72) Inventors: Anjum K Gupta, San Diego, CA (US); Emmanuel Pun, San Diego, CA (US)

(73) Assignee: 2Go Products LLC, San Diego, CA (US)

( * ) Notice: Subject to any disclaimer, the term of this patent is extended or adjusted under 35 U.S.C. 154(b) by 125 days.

(21) Appl. No.: 15/130,826

(22) Filed: Apr. 15, 2016

(65) Prior Publication Data

US 2017/0298609 A1 Oct. 19, 2017

(51) Int. Cl.

*A61H 35/00* (2006.01)
*E03D 9/08* (2006.01)
*B05B 1/02* (2006.01)

(52) U.S. Cl.

CPC . *E03D 9/08* (2013.01); *B05B 1/02* (2013.01)

(58) Field of Classification Search

CPC .. E03D 9/085; E03D 9/08; B05B 1/02; B05B 1/00; B05B 1/14; B05B 15/065
USPC ..... 4/448; 239/589, 600
See application file for complete search history.

(56) References Cited

U.S. PATENT DOCUMENTS 3,164,846 A * 1/1965 Foster ..... A61M 3/0225 4/420.1
4,042,174 A * 8/1977 Vaughn ..... B05B 1/02 239/391
4,123,807 A * 11/1978 Oguma ..... E03D 9/08 392/471
4,550,454 A * 11/1985 Yui ..... E03D 9/08 239/461
4,704,748 A * 11/1987 Takeda ..... E03D 9/08 4/420.4
5,025,511 A * 6/1991 Takeda ..... E03D 9/08 4/444
5,050,249 A * 9/1991 Takeda ..... E03D 9/08 4/420.4
5,271,566 A * 12/1993 Dederich ..... B05B 15/066 239/600
5,864,895 A * 2/1999 Ota ..... A47K 7/08 4/443
5,934,569 A * 8/1999 Soule ..... B05B 1/3442 239/468
6,249,921 B1 * 6/2001 Daniel ..... E03D 9/08 239/428.5
7,954,181 B2 * 6/2011 Lim ..... A61M 3/0225 4/420
9,044,533 B2 * 6/2015 Shi ..... A61M 3/0225
9,637,904 B2 * 5/2017 Slothower ..... E03D 9/085
2002/0042946 A1 * 4/2002 Jeon ..... E03D 9/08 4/420.4
2003/0057302 A1 * 3/2003 Swan ..... B05B 1/267 239/597

(Continued)

*Primary Examiner* — Benjamin R Shaw

(57) ABSTRACT

The disclosure provides a bidet nozzle assembly, which includes a nozzle housing; a nozzle, the nozzle having a distal end and a proximal end, the nozzle including a channel through to the distal end and to the proximal end, the channel having a first channel opening at the distal end and a second channel opening at the proximal end; a nozzle insert, the nozzle insert located at the first channel opening of the distal end of the nozzle, the nozzle insert having at least one nozzle hole; and a nozzle cap.

10 Claims, 9 Drawing Sheets

(56) References Cited

U.S. PATENT DOCUMENTS

| | | | | |
|---|---|---|---|---|
| 2005/0121542 | A1* | 6/2005 | Su Lim | A47K 13/00 239/525 |
| 2010/0162475 | A1* | 7/2010 | Hashidume | E03D 9/08 4/233 |
| 2011/0010834 | A1* | 1/2011 | Park | B05B 15/065 4/448 |
| 2012/0304371 | A1* | 12/2012 | Duvencioglu | E03D 9/08 4/448 |
| 2013/0042400 | A1* | 2/2013 | Ji | A61H 35/00 4/443 |
| 2013/0341423 | A1* | 12/2013 | Dziubasik | B05B 1/3421 239/14.2 |
| 2014/0352049 | A1* | 12/2014 | Nakamura | E03D 9/08 4/448 |
| 2015/0233105 | A1* | 8/2015 | Slothower | E03D 9/085 4/448 |
| 2015/0305577 | A1* | 10/2015 | Gupta | A47K 13/26 4/448 |
| 2016/0053474 | A1* | 2/2016 | Defu | E03D 9/08 239/589 |

* cited by examiner

BIDET NOZZLE INSERT

FIELD OF THE DISCLOSURE

Embodiments of the present disclosure relate to a bidet apparatus for use with a toilet bowl, which provides for the washing and cleaning of body parts of a person sitting on or near the bowl. More particularly, embodiments of the present disclosure relate to an interchangeable and replaceable bidet nozzle insert for producing different types of wash water sprays.

BACKGROUND OF THE DISCLOSURE

A bidet apparatus for washing and cleaning body parts (e.g., genital and/or anal) using water spray was initially developed in the form of a bidet that provided a single spray of water and was permanently built into a toilet bowl. These bidets were expensive to build and a new generation of bidets were developed that reversibly attached to the seat or bowl of a toilet, and which included a plurality of nozzles for multiple water sprays for washing body parts as well as the bidet itself.

Existing bidets fail to address all concerns relating to the design and function in the general field of bidets. For example, pollution of the outer surface of the nozzles is a common problem and causes aesthetic and hygienic issues. This is particularly important in bidets used, for example, by infirm or sick people who have to be especially cautious about maintaining hygiene and preventing infections.

Mobile cleaning and bidet systems have been developed, which operate according to various techniques in order to overcome these problems, for example, bidets disclosed in U.S. Patent Application Nos. 2014/0101838 and 2015/0305577, the disclosures of each of which are hereby incorporated by reference in their entireties. Such bidets include a mechanical system that retracts the nozzles within a cylindrical covering to prevent pollution during use. When activated by a mechanical signal, the nozzles move forward within the body of the cylinder. The mechanical signal acts by the force of the washing water that pushes the nozzle out of its outer covering and thus, washing water is sprayed on the person sitting on the toilet. When the washing water supply is stopped, the nozzle is retracted. Therefore, when a user uses the lavatory, the user's excrement is not splattered directly on the nozzles since the nozzles are accommodated within the outer covering.

The nozzles of a bidet may still become dirty when the user is being washed by the washing water sprayed from the nozzle. Some bidets overcome this by allowing the user to pull out the nozzle manually and clean the nozzle after use. This is both cumbersome and unpleasant. Some other bidets have a cleaning nozzle to wash the washing nozzles after usage. This is also undesirable because of nozzle positions and dripping of the nozzle washing water. Therefore, there remains a need in the art for a bidet apparatus that includes interchangeable and replaceable bidet nozzles.

SUMMARY OF THE INVENTION

The presently disclosed embodiments are directed to solving one or more of the problems presented in the prior art, described above, as well as providing additional features that will become readily apparent by reference to the following detailed description when taken in conjunction with the accompanying drawings.

In an embodiment, the disclosure provides a bidet nozzle assembly, which includes: a nozzle housing; a nozzle, the nozzle having a distal end and a proximal end, the nozzle including a channel through to the distal end and to the proximal end, the channel having a first channel opening at the distal end and a second channel opening at the proximal end; a nozzle insert, the nozzle insert located at the first channel opening of the distal end of the nozzle, the nozzle insert having at least one nozzle hole; and a nozzle cap.

In other embodiments, the disclosure provides a bidet nozzle assembly, which includes the nozzle insert having a lower base and an upper platform, the upper platform including the at least one nozzle hole.

In other embodiments, the disclosure provides a bidet nozzle assembly, wherein the distal end of the nozzle is externally treaded and the nozzle cap is internally threaded, and wherein the externally threaded distal end of the nozzle is reversibly attachable to the internally threaded end of the nozzle cap.

In other embodiments, the disclosure provides a bidet nozzle assembly, which includes a sealing O-ring between the externally threaded distal end of the nozzle and the internally threaded end of the nozzle cap.

In other embodiments, the disclosure provides a bidet nozzle assembly, wherein the first channel opening at the distal end of the nozzle and the upper platform of the nozzle insert form supplementary angles.

In other embodiments, the disclosure provides a bidet nozzle assembly, wherein the upper platform of the nozzle insert includes a plurality of nozzle holes.

In other embodiments, the disclosure provides a bidet nozzle assembly, which includes a third slot opening located at the distal end of the nozzle, the third slot opening for receiving the lower base of the nozzle insert.

In other embodiments, the disclosure provides a bidet nozzle assembly, wherein the nozzle cap is directly attached to the lower base of the nozzle insert.

In other embodiments, the disclosure provides a bidet nozzle assembly, wherein the nozzle housing encompasses the nozzle and nozzle insert, at least in part, in a retracted position, and the nozzle and nozzle insert extend from the nozzle housing, at least in part, in an extended position.

In other embodiments, the disclosure provides a bidet nozzle assembly, which includes a spring mechanism for retracting the nozzle and nozzle insert, at least in part, into the nozzle housing in the retracted position.

In other embodiments, the disclosure provides a bidet nozzle assembly, wherein water pressure in the nozzle channel extends the nozzle and nozzle insert, at least in part, into the extended position.

In other embodiments, the disclosure provides a bidet nozzle assembly, which includes a flow diverter, the flow diverter located at the distal end of the nozzle, wherein the flow diverter acts to regulate water flow through the nozzle channel, the nozzle insert, and the at least one nozzle hole.

Further features and advantages of the present disclosure, as well as the structure and operation of various embodiments of the present disclosure, are described in detail below with reference to the accompanying drawings.

BRIEF DESCRIPTION OF THE DRAWINGS

The present disclosure, in accordance with one or more various embodiments, is described in detail with reference to the following figures. The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DETAILED DESCRIPTION OF EXEMPLARY EMBODIMENTS

Figure 1:
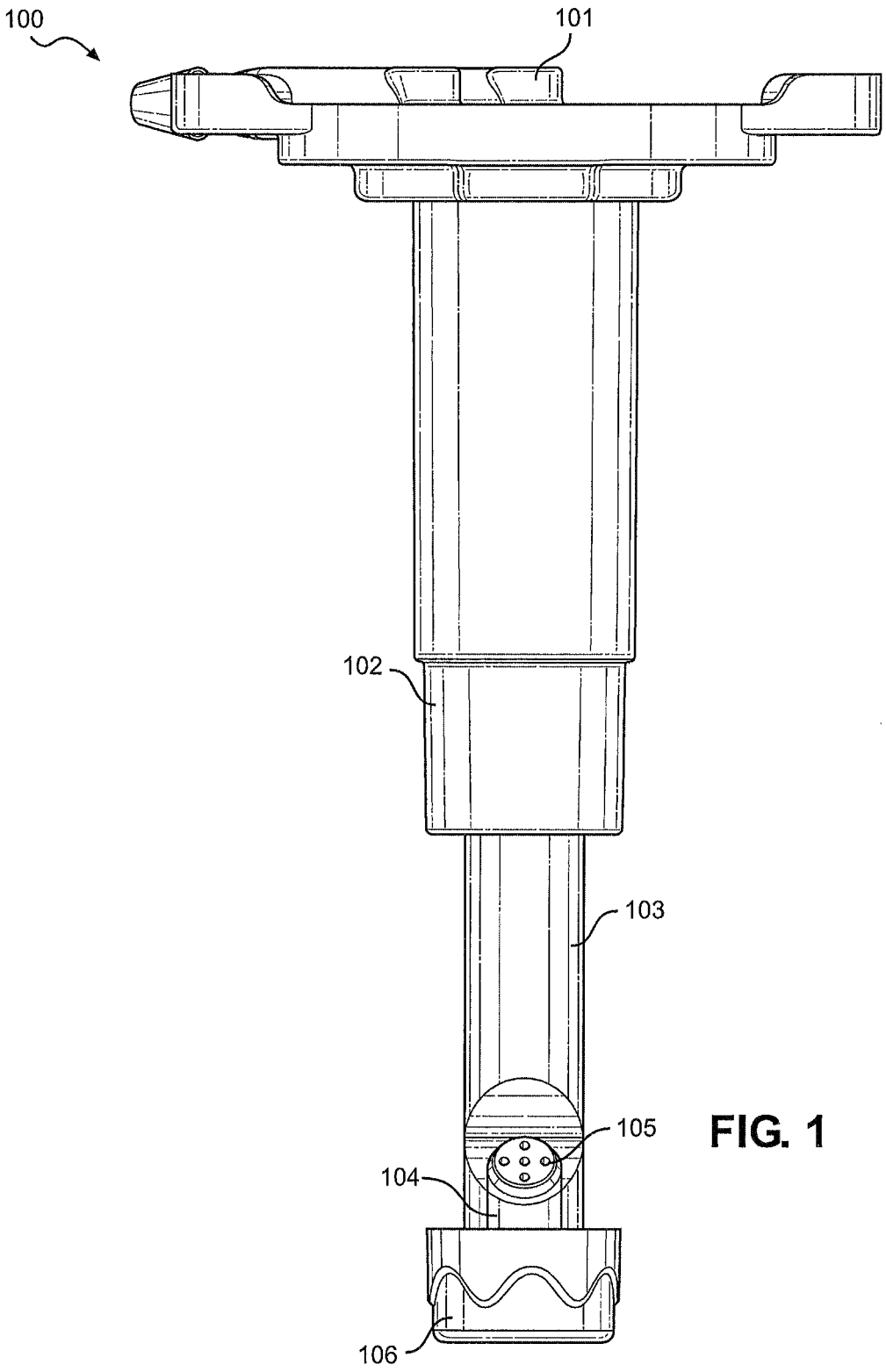
FIG. 1 provides an illustrative embodiment of an exemplary front view of an extended bidet nozzle assembly.

The following description is presented to enable a person of ordinary skill in the art to make and use embodiments described herein. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the disclosure. Thus, the present disclosure is not intended to be limited to the examples described herein and shown, but is to be accorded the scope consistent with the claims.

The word "exemplary" is used herein to mean "serving as an example illustration." Any aspect or design described herein as "exemplary" is not necessarily to be construed as preferred or advantageous over other aspects or designs.

It should be understood that the specific order or hierarchy of steps in the process disclosed herein is an example of exemplary approaches. Based upon design preferences, it is understood that the specific order or hierarchy of steps in the processes may be rearranged while remaining within the scope of the present disclosure. Any accompanying method claims present elements of the various steps in a sample order, and are not meant to be limited to the specific order or hierarchy presented.

Embodiments of the present disclosure relate to an interchangeable and replaceable nozzle insert as used with a bidet apparatus installed on a toilet for cleaning the private parts of a person. Operating the bidet involves opening a valve that directs wash water through the nozzle assembly, in which a nozzle extends out of its housing via water pressure, and a stream of wash water shoots outwards through the nozzle insert to clean the private parts of the person seated on or near the toilet. When the valve is closed and the water pressure drops, a linear spring retracts the nozzle back into its housing.

The nozzle assembly includes a nozzle with an interchangeable and replaceable nozzle insert, which is held in place in the nozzle by slot located in the bottom portion of the nozzle. The bottom portion of the nozzle can be threaded and sealed together with an O-ring and a threaded nozzle cap. Removing the nozzle cap allows the nozzle insert to be taken out and replaced if needed or desired. Different nozzle inserts are available with various arrangements and sizes of holes that can each produce different types of wash water spray. For example, one nozzle insert can be designed to produce a more aerated wash water stream, whereas another nozzle insert can be designed to produce a stronger jet of water. Thus, the wash water spray from the bidet nozzle can be easily customized based on the desires/needs of a particular user. The nozzle insert also allows for ease in manufacturing of the bidet. For example, the holes in the nozzle insert can be molded in a way that provides higher quality parts than if the nozzle was molded as one piece.

Thus, in an embodiment, the disclosure provides a bidet nozzle assembly, which includes: a nozzle housing; a nozzle having a proximal end and a distal end, the distal end of the nozzle being externally threaded and including a slot; a nozzle insert located in the slot of the nozzle, the nozzle insert having a lower base and an upper top lip, the upper top lip having at least one nozzle hole; and a nozzle cap, wherein the nozzle cap is internally threaded and is reversibly attached to the distal threaded end of the nozzle.

Reference will now be made in detail to aspects of the subject technology, examples of which are illustrated in the accompanying drawings, wherein like reference numerals refer to like elements throughout.

FIG. 1 illustrates an embodiment of a front view of a bidet nozzle assembly 100. As shown in this figure, the bidet nozzle assembly 100 includes a nozzle cover 101, which can be removed to attach the assembly to a tubing, pipe or conduit connected to a water supply. A nozzle housing 102 partially encompasses a nozzle 103 as shown in this retracted position. The nozzle 103 is shown in an extended view for illustration purposes. The nozzle 103 includes an internal channel (not shown), which runs from the proximal end to the distal end of the nozzle, which is used for conveying or transporting wash water. The distal end of the nozzle 103 includes a nozzle insert 104 having a plurality of nozzle holes 105 for spraying or dispersing the wash water. As shown, the distal end of the nozzle 103, includes a nozzle cap 106 for securing the nozzle insert 104 to the distal end of the nozzle 103.

Figure 2:
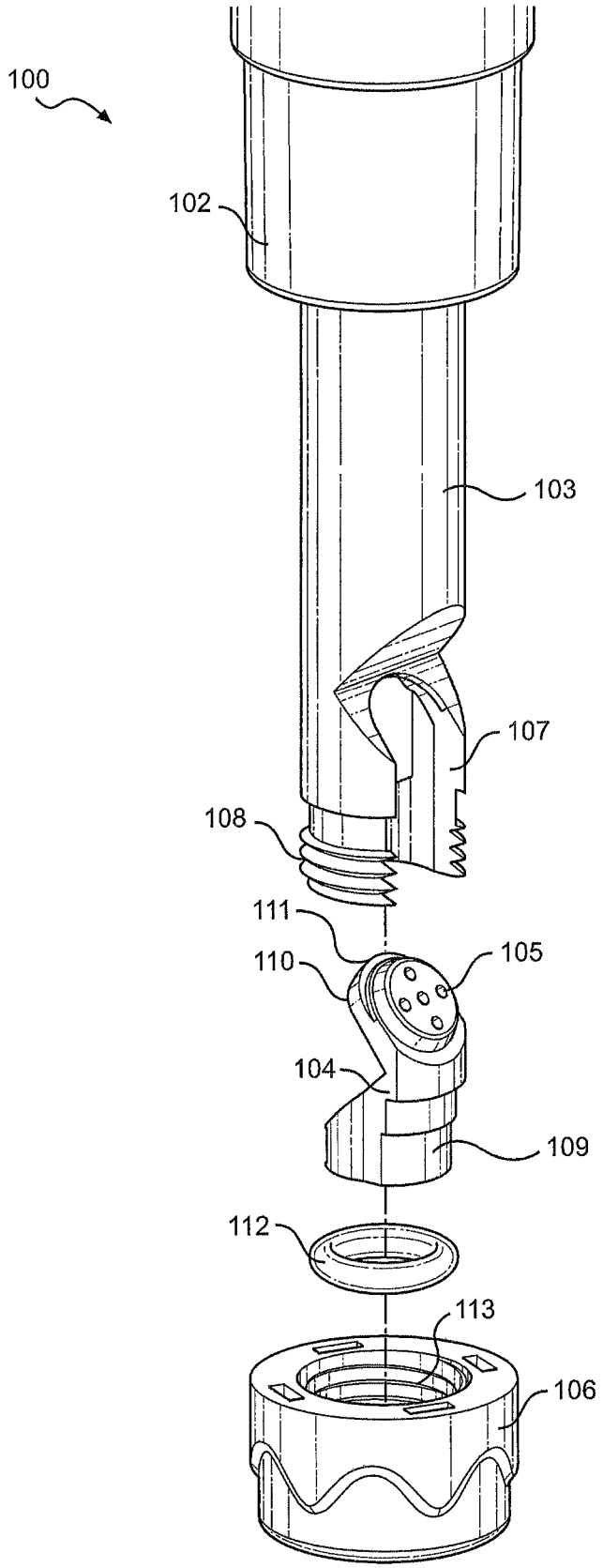
FIG. 2 provides an illustrative embodiment of an exemplary front view of an exploded, extended bidet nozzle assembly.

FIG. 2 illustrates another embodiment of an exploded, extended view of the nozzle assembly 100. As indicated in this figure, the nozzle 103 can extend from the nozzle housing 102. The distal end of the nozzle 103 includes an angled nozzle insert slot 107, which can be angled complimentary to the nozzle insert 104 so they form supplementary angles (i.e. the two angles add up to 180 degrees). The angle of the nozzle insert 104 and the angled nozzle insert slot 107 can be any angle convenient for delivery of wash water, for example from about 30 degrees, from about 45 degrees, from about 60 degrees, and the like, so long as they form supplementary angles. The distal end of the nozzle 103 can include external threads 108 for securing the distal end of the nozzle 103 to the nozzle cap 106, which can include internal threads (not shown) on the nozzle cap 106. As shown, the nozzle insert 104 includes a nozzle insert base 109 and a nozzle insert platform 110, which can include a lip 111 that can be secured against the angled nozzle insert slot 107 of the nozzle 103. In addition, the nozzle insert 104 can be secured in the angled nozzle insert slot 107 through a lower sealing O-ring 112 and the nozzle cap 106, which can include internal threads 113.

Figure 3:
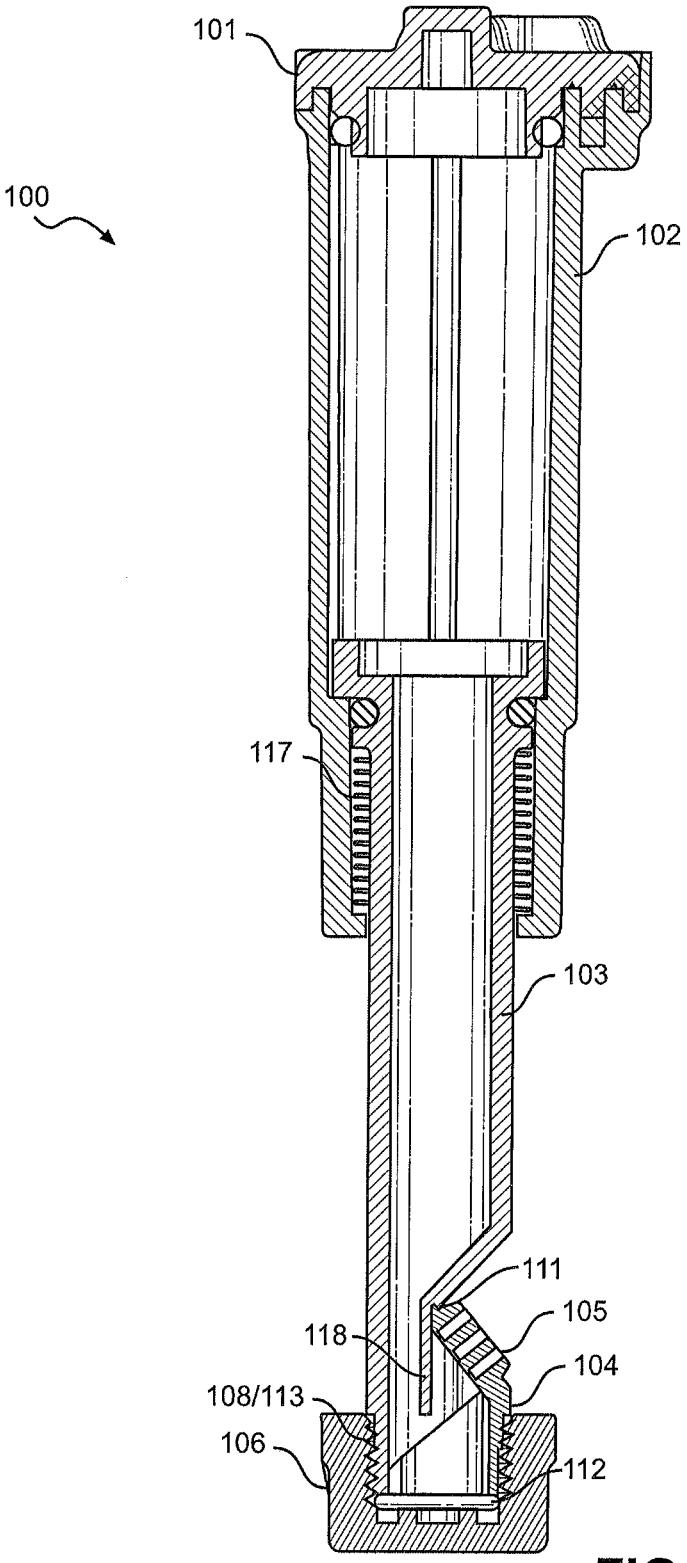
FIG. 3 provides an illustrative embodiment of an exemplary front, cut-away, axial view of an extended bidet nozzle assembly.

FIG. 3 illustrates another embodiment of a front, cut-away, axial view of the extended nozzle assembly 100. As indicated in this figure, an upper sealing O-ring 114 can be used for sealing the nozzle cover 101 with the nozzle housing 102. As shown, the nozzle housing 102 includes a nozzle housing slot 115, in which the nozzle 103 can extend from and retract into. Also shown is a middle sealing O-ring 116 and a spring 117, which acts to seal and retract the nozzle 103, respectively, into the nozzle housing 102. A flow diverter 118, located at the lower end of the angled nozzle insert slot 107 of the nozzle 103, acts to regulate wash water flow through the nozzle insert 104 and nozzle holes 105. Also shown in this figure is the nozzle insert platform 110 and lip 111 of the nozzle insert 104, the external threads 108 of the distal end of the nozzle 103, the internally threaded nozzle cap 106, and lower sealing O-ring 112.

Figure 4:
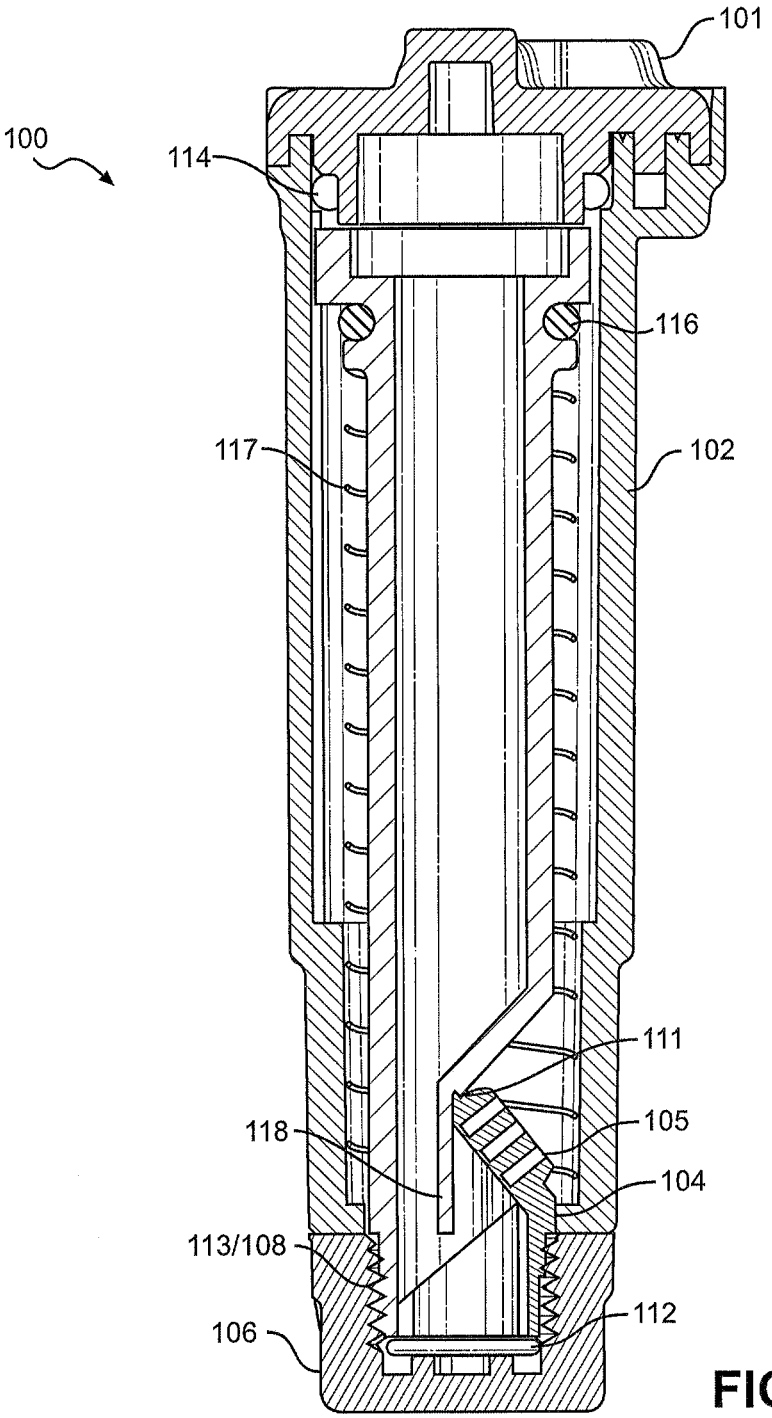
FIG. 4 provides an illustrative embodiment of an exemplary front, cut-away, axial view of a retracted bidet nozzle assembly.

FIG. 4 illustrates another embodiment of a front, cut-away, axial view of a retracted bidet nozzle assembly 100. As indicated in this figure, an upper sealing O-ring 114 can be used for sealing the nozzle cover 101 with the nozzle housing 102. As shown, the nozzle housing 102 includes a nozzle housing slot 115, in which the nozzle 103 can be retracted. Also shown is the middle sealing O-ring 116 and spring 117, which acts to seal and retract the nozzle 103, respectively, into the nozzle housing 102. A flow diverter 118, at the lower end of the angled nozzle insert slot 107 of the nozzle 103, can act to regulate wash water flow through the nozzle insert 104 and nozzle holes 105. Also shown in this figure is the nozzle insert platform 110 and lip 111 of the nozzle insert 104, the external threads 108 of the distal end of the nozzle 103, the internally threaded nozzle cap 106, and lower sealing O-ring 112.

Figure 5:
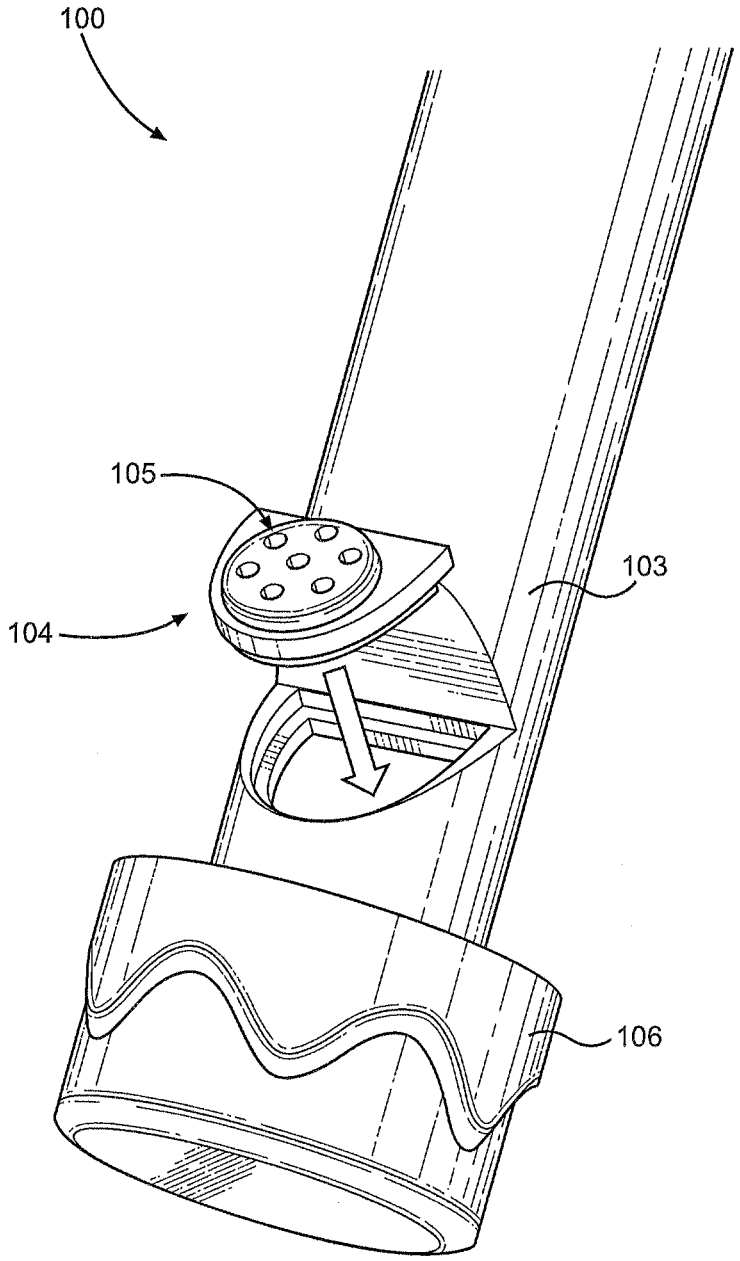
FIG. 5 provides an illustrative embodiment of an exemplary front view of an exploded, extended bidet nozzle assembly with a nozzle insert having at least one nozzle hole.

FIG. 5 illustrates another embodiment of a front view of an exploded, extended bidet nozzle assembly 100 with a nozzle insert 104 and nozzle holes 105. In this embodiment, the nozzle insert 104 is directly, removably attachable to the distal end of the nozzle 103 by being, for example, snapped and secured into place, or can be permanently attached to the nozzle with an adhesive substance such as glue. Also shown in this figure is the nozzle cap 106 secured at the distal end of the nozzle 103 as described herein.

Figure 6A:
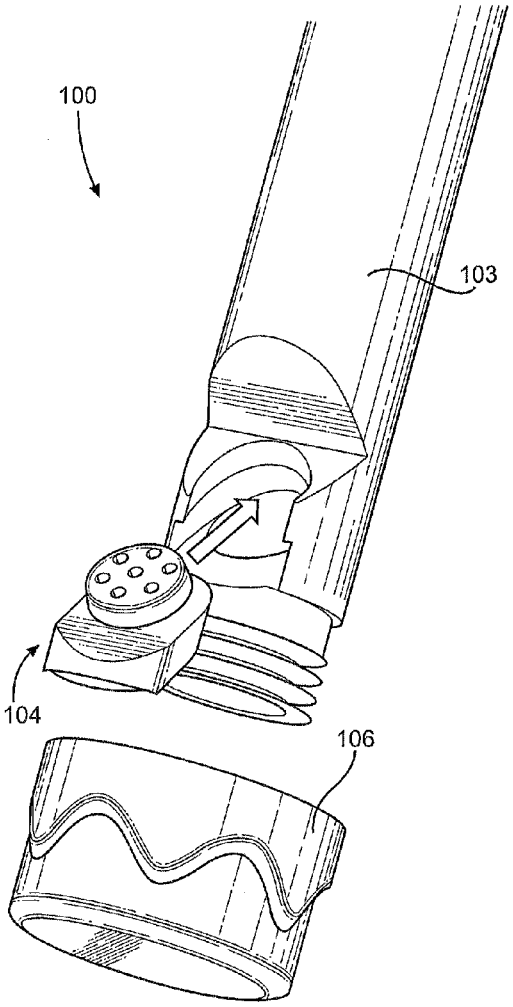
FIGS. 6A and 6B provide an illustrative embodiment of an exemplary front view of an exploded, extended bidet nozzle assembly with a nozzle insert having at least one nozzle hole.
Figure 6B:
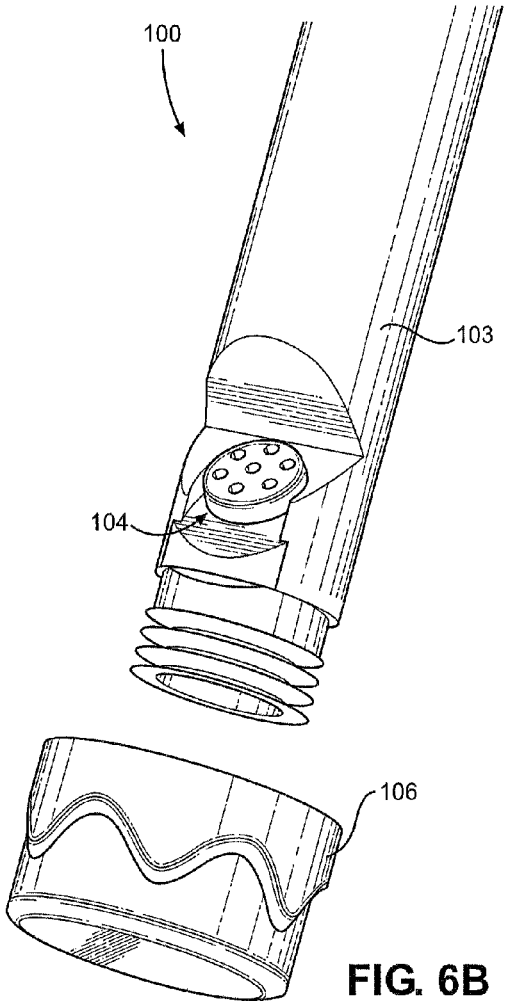

FIGS. 6A and 6B illustrate another embodiment of a front view of an exploded, extended bidet nozzle assembly 100 with a nozzle insert 104 and nozzle holes 105. In this embodiment, the nozzle insert 104 is directly, removably attachable to the distal end of the threaded nozzle 103 by being slid into place, or can be permanently attached to the nozzle with an adhesive substance such as glue. Also shown in this figure is the nozzle cap 106, which can be secured at the distal end of the nozzle 103 as described herein.

Figure 7:
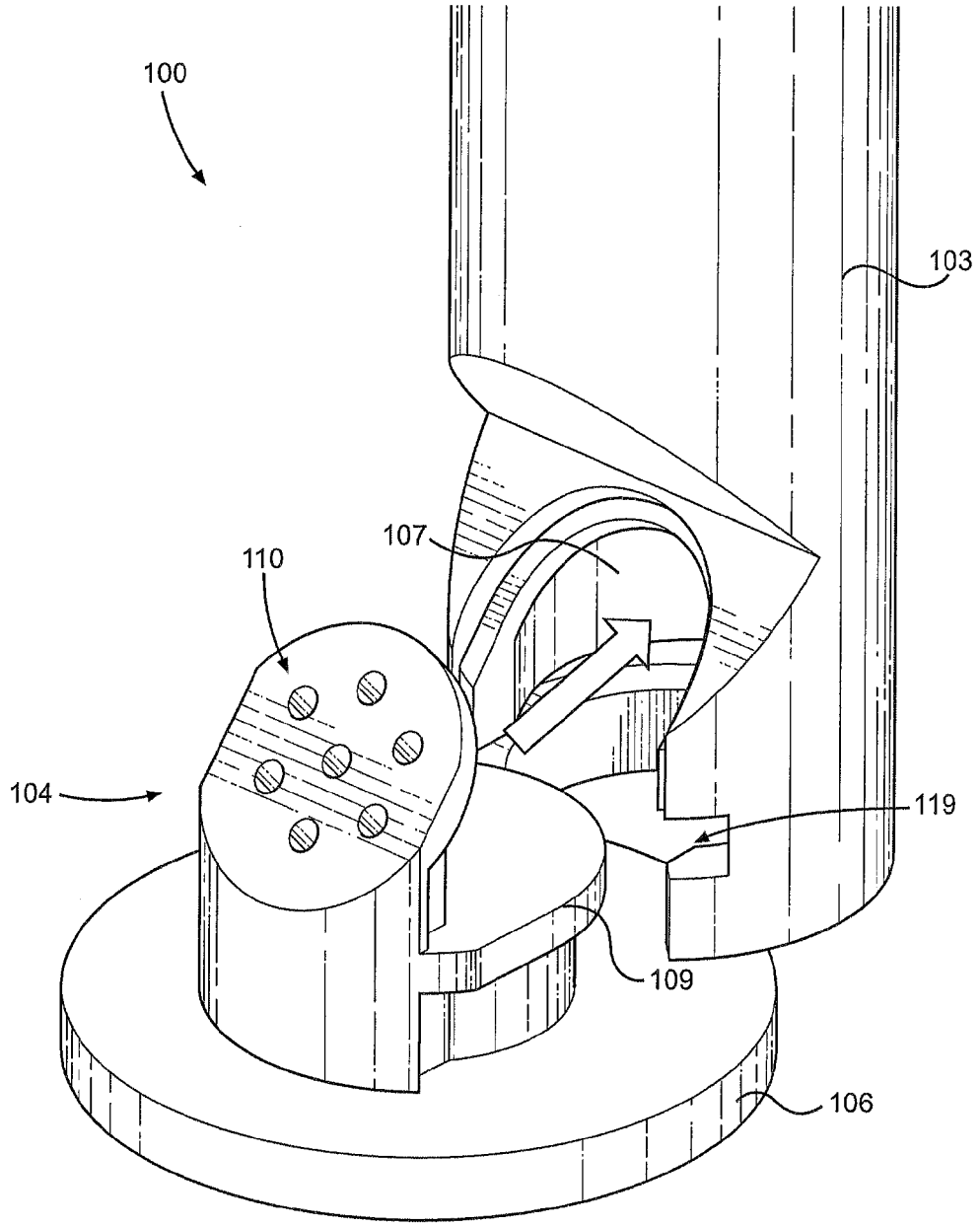
FIG. 7 provides an illustrative embodiment of a front view of an exploded, extended bidet nozzle assembly having a slidably, removable nozzle insert.

FIG. 7 illustrates another embodiment of a front view of an exploded, extended bidet nozzle assembly 100. In this figure, the distal end of the nozzle 103 is unthreaded, and includes the angled nozzle insert slot 107 and a lower nozzle insert base slot 119 for securing the nozzle insert 104. As shown in this figure, the nozzle insert 104 can be slidable, removeably attached to the distal end of the nozzle 103, or can be permanently secured thereto through use of an adhesive such as a glue, by inserting the nozzle insert base 109 and nozzle insert platform 110 into the lower nozzle insert base slot 119 and angled nozzle insert slot 107, respectively. Also shown is the nozzle cap 106, which is directly attached to the nozzle insert base 109.

Figure 8A:
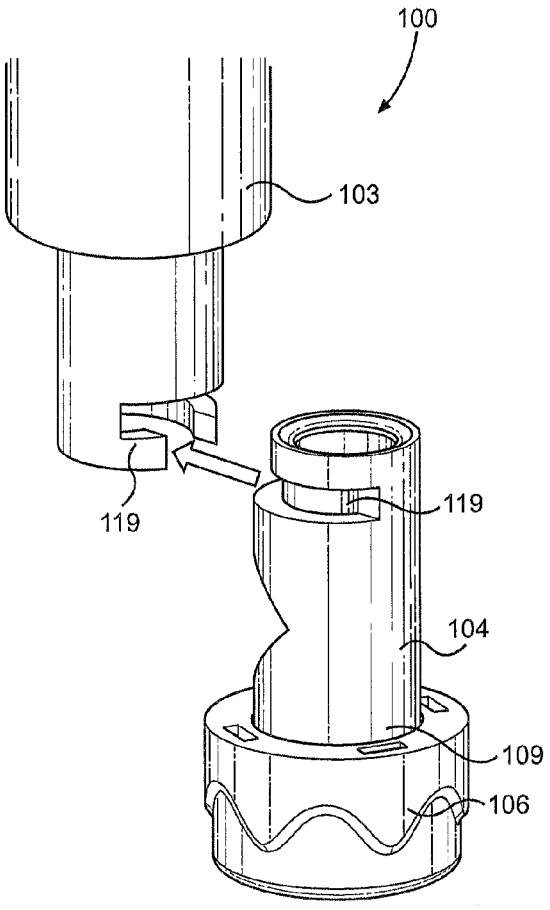
FIGS. 8A and 8B provide an illustrative embodiment of a rear, side view of an exploded, extended bidet nozzle assembly having a slidably, removable nozzle insert.
Figure 8B:
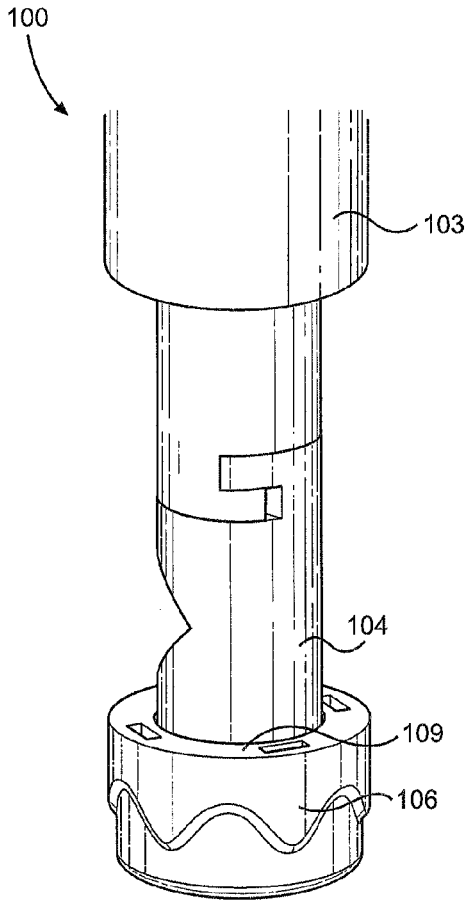

FIGS. 8A and 8B illustrate another embodiment of a rear, side view of an exploded, extended bidet nozzle assembly 100. In this figure, the distal end of the nozzle 103 is unthreaded, and includes a nozzle insert base slot 119 for securing the nozzle insert 104 through a nozzle insert top slot 119. As shown in this figure, the nozzle insert 104 can be slidable, removeably attached to the distal end of the nozzle 103, or can be permanently secured thereto through use of an adhesive such as a glue. Also shown is the nozzle cap 106, which can be attached to the nozzle insert base 109 as described herein.

Figure 9:
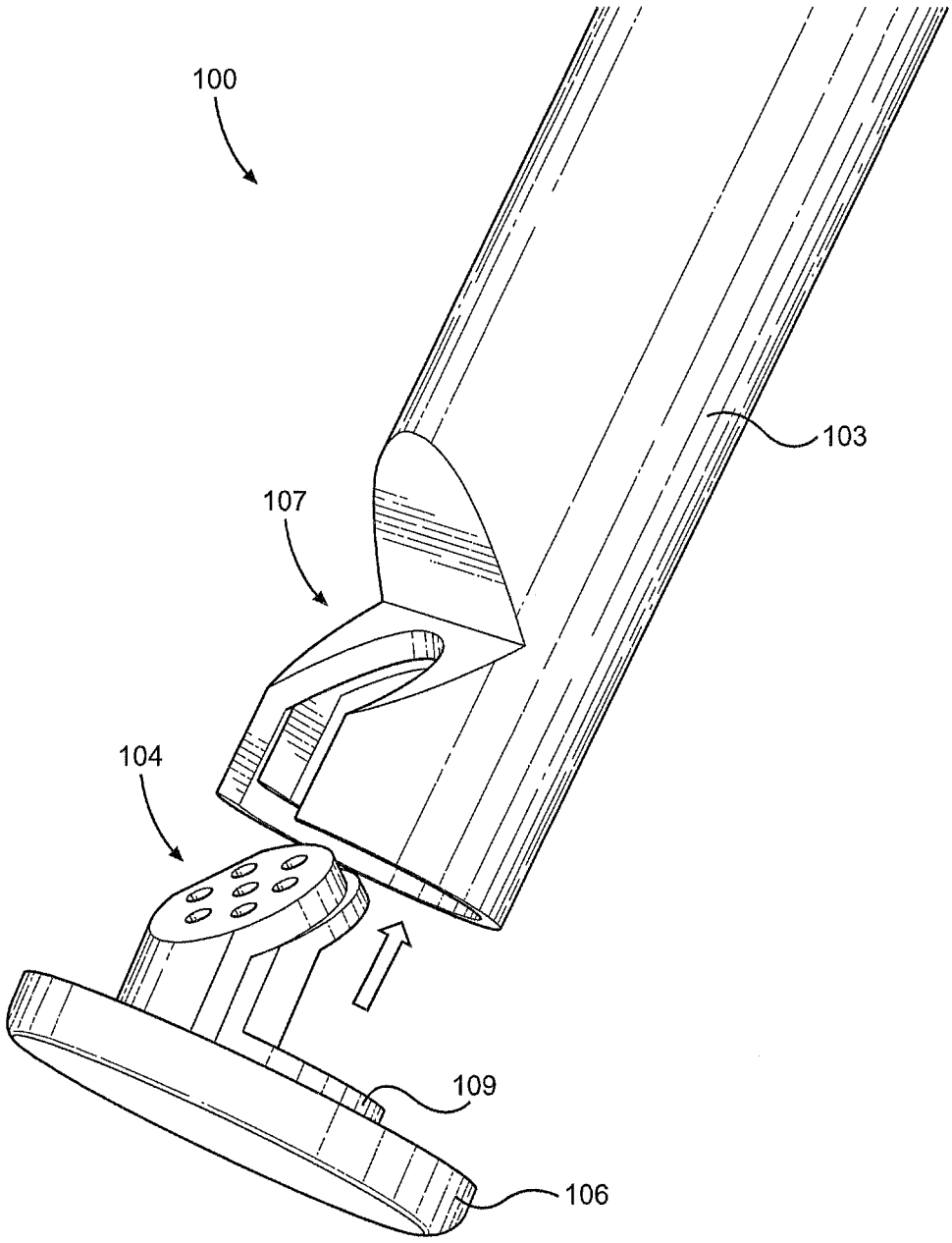
FIG. 9 provides an illustrative embodiment of a side view of an exploded, extended bidet nozzle assembly having permanently placed nozzle insert.

FIG. 9 illustrates another embodiment of a side view of an exploded, extended bidet nozzle assembly 100. In this figure, the distal end of the nozzle 103 is also unthreaded, and includes the angled nozzle insert slot 107. As shown in this figure, the nozzle insert 104 can be slidable, removeably attached to the distal end of the nozzle 103, or can be permanently secured thereto through use of an adhesive such as a glue. Also shown is the nozzle cap 106, which is directly attached to the nozzle insert base 109.

While the inventive features have been particularly shown and described with reference to preferred embodiments thereof, it will be understood by those in the art that the foregoing and other changes may be made therein without departing from the sprit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations, but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus, the breadth and scope of the present disclosure should not be limited by any of the above-described exemplary embodiments.

The invention claimed is:

1. A bidet nozzle comprising:

a nozzle housing;

a nozzle, the nozzle having a distal end and a proximal end, the nozzle including a channel through to the distal end and to the proximal end, the channel having a first channel opening at the distal end and a second channel opening at the proximal end;

a nozzle insert, the nozzle insert located at the first channel opening of the distal end of the nozzle, the nozzle insert having at least one nozzle hole;

a nozzle cap; and a third slot opening located at the distal end of the nozzle, the third slot opening for receiving the lower base of the nozzle insert, wherein the nozzle cap is directly attached to the lower base of the nozzle insert.

2. The bidet nozzle assembly of claim 1, further comprising:

the nozzle insert including a lower base and an upper platform, the upper platform including the at least one nozzle hole.

3. The bidet nozzle assembly of claim 2, wherein the distal end of the nozzle is externally threaded and the nozzle cap is internally threaded, and wherein the externally threaded distal end of the nozzle is reversibly attachable to the internally threaded end of the nozzle cap.

4. The bidet nozzle assembly of claim 3, further comprising: a sealing O-ring between the externally threaded distal end of the nozzle and the internally threaded end of the nozzle cap.

5. The bidet nozzle assembly of claim 2, wherein the first channel opening at the distal end of the nozzle and the upper platform of the nozzle insert form supplementary angles along a longitudinal axis of the nozzle.

6. The bidet nozzle assembly of claim 2, wherein the upper platform of the nozzle insert includes a plurality of nozzle holes.

7. The bidet nozzle assembly of claim 1, wherein the nozzle housing encompasses the nozzle and nozzle insert, at least in part, in a retracted position, and the nozzle and nozzle insert extend from the nozzle housing, at least in part, in an extended position.

8. The bidet nozzle assembly of claim 7, further comprising a spring mechanism for retracting the nozzle and nozzle insert, at least in part, into the nozzle housing in the retracted position.

9. The bidet nozzle assembly of claim 7, wherein water pressure in the nozzle channel extends the nozzle and nozzle insert, at least in part, into the extended position.

10. The bidet nozzle assembly of claim 1, further comprising:

a flow diverter, the flow diverter located at the distal end of the nozzle, wherein the flow diverter acts to divert water flow through the nozzle insert and the at least one nozzle hole.

* * * * *